US005140976A

United States Patent [19]

Cheng

[11] Patent Number: 5,140,976

[45] Date of Patent: Aug. 25, 1992

[54] MASSAGER WITH MERCURY SWITCH

[76] Inventor: Tzu-Keng Cheng, 197 Shin-Sheng Street, Chung-Ho City, Taipei, Taiwan

[21] Appl. No.: 750,253

[22] Filed: Aug. 27, 1991

[51] Int. Cl.[5] ..... A61H 1/00

[52] U.S. Cl. ..... 128/32; 128/36

[58] Field of Search ..... 128/32, 33, 66, 80 C, 128/36

[56] References Cited

U.S. PATENT DOCUMENTS

| | | | |
|---|---|---|---|
| 1,832,437 | 4/1928 | Wahl | 128/32 |
| 3,057,348 | 10/1962 | Baer | 128/32 |
| 3,802,422 | 4/1974 | Hurst | 128/66 |
| 3,885,576 | 5/1975 | Symmes | 128/802 |
| 3,981,032 | 9/1976 | Brooks | 128/33 |
| 4,093,944 | 6/1978 | Muncheryan | 128/32 |
| 4,796,631 | 1/1989 | Grigoryev | 128/80 C |
| 4,935,972 | 6/1990 | Brady | 5/437 |
| 5,016,616 | 5/1991 | Hu | 128/32 |

*Primary Examiner*—Robert A. Hafer
*Assistant Examiner*—David J. Kenealy
*Attorney, Agent, or Firm*—Bacon & Thomas

[57] ABSTRACT

A massager comprising a vibrator unit connected to a power supply unit, which is floatable in water, through an electric wire via a mercury switch and respectively sealed against water for operation under water. The mercury switch is connected when the power supply unit is disposed in a vertical position or power supply is cut off from the vibrator unit when the power supply unit is tilted or caused to tilt. The vibrator unit is covered with a mattress which has raised portions on the top for massaging and a plurality of suction discs and a hanging ring around the peripheral edge thereof for fastening in place.

1 Claim, 5 Drawing Sheets (B)

MASSAGER WITH MERCURY SWITCH

BACKGROUND OF THE INVENTION

The present invention relates to massagers and relates more particularly to a massager which is easy to operate and convenient to carry and, which can also be used under water.

Various motor-operated massaging devices have been disclosed for rubbing the foot, the back, or any part of the body so as to stimulate circulation and make muscles or joints supple. In the known structures of motor-operated massaging devices, either fixed type of portable, the vibrator unit is generally controlled to operated by a control switch. The control switch which controls the operation of a motor-operated massaging device is generally made on the massaging device at a fixed location. When in use, it is not convenient to control the control switch. Further, the known structures of motor-operated massaging devices are not applicable for use under water.

SUMMARY OF THE INVENTION

The present invention has been accomplished to eliminate the aforesaid disadvantages. It is therefore an object of the present invention to provide a massager which is easy to operate and convenient to carry. It is another object of the present invention to provide a massager which can be simultaneously used under water. It is still another object of the present invention to provide a massager which has fastening means for fastening in place.

According to the present invention, there is provided a massager which is generally comprised of a power supply unit which is controlled by a mercury switch, and a vibrator unit connected to said power supply unit by an electric wire. Power supply is connected to the vibrator unit when the mercury switch is disposed in a vertical position. The vibrator unit stops its operation when the mercury switch is tilted or caused to tilt. The power supply unit and the vibrator unit are respectively sealed against water so that the massager can be used under water. The power supply unit is generally comprised of a broad-brimmed casing which when placed in water will be floated, causing the mercury switch therein to be electrically connected. The vibrator unit is covered with a mattress which has a plurality of raised portions on the top for massaging and a plurality of suction discs and a handing ring around the peripheral edge thereof for fastening in place.

BRIEF DESCRIPTION OF THE DRAWINGS

FIG. 3-B illustrates that the mercury switch of the power supply thereof has been electrically cut off;

DETAILED DESCRIPTION OF THE PREFERRED EMBODIMENT

Figure 1:
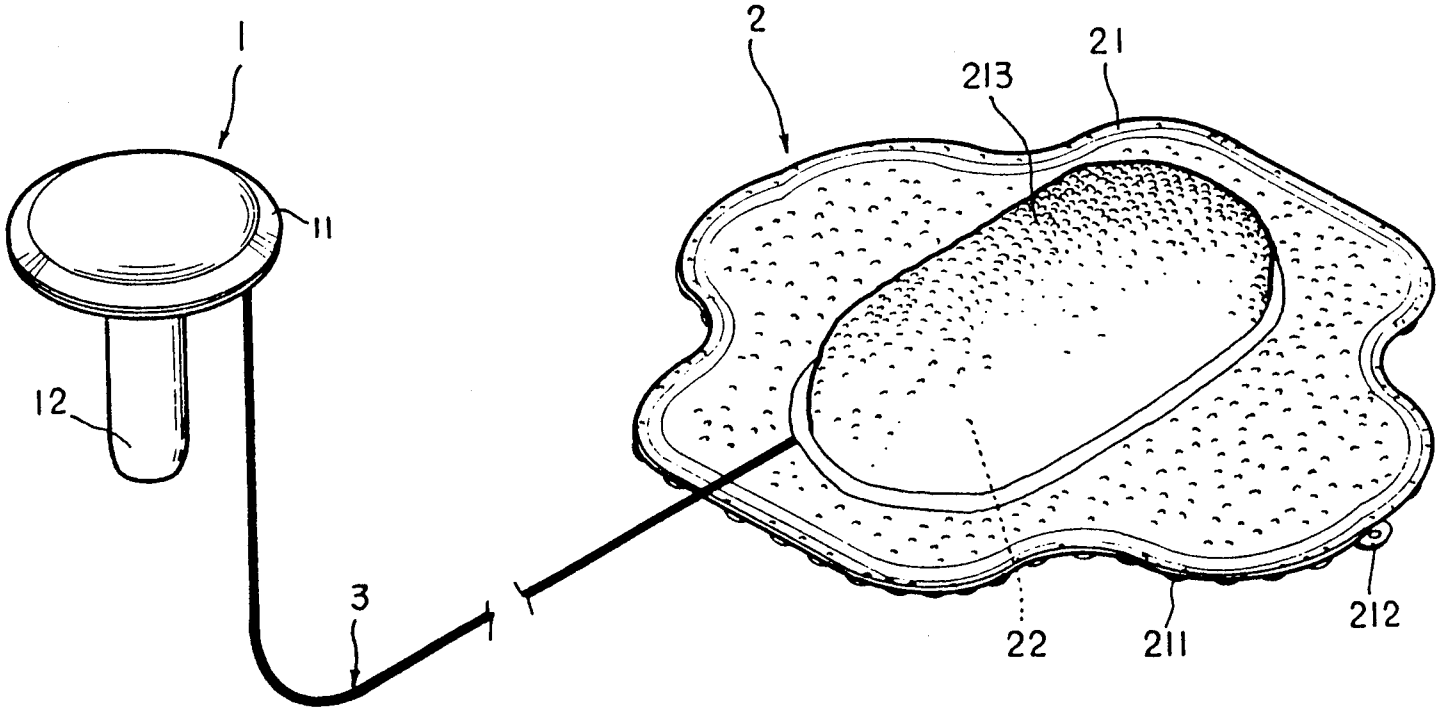
FIG. 1 is a perspective view of the preferred embodiment of the massager of the present invention.

Referring to FIG. 1, a massager as constructed in accordance with the present invention is generally comprised of a power supply unit 1, a vibrator unit 2 and an electric wire 3 connected therebetween. The power supply unit 1 comprises a broad-brimmed casing 11 having a battery box 12 attached thereto at the bottom. The vibrator unit 2 comprises a mattress 21 covered over a vibrator assembly 22. The mattress 21 of the vibrator unit 2 has a plurality of suction discs 211 on the back and a hanging ring 212 on the peripheral edge thereof at a suitable location respectively provided for securing the vibrator unit 2 in place, and a plurality of raised portions 213 on the top surface thereof which are provided for rubbing the muscles and joints when the vibrator assembly 22 is turned on.

Figure 2:
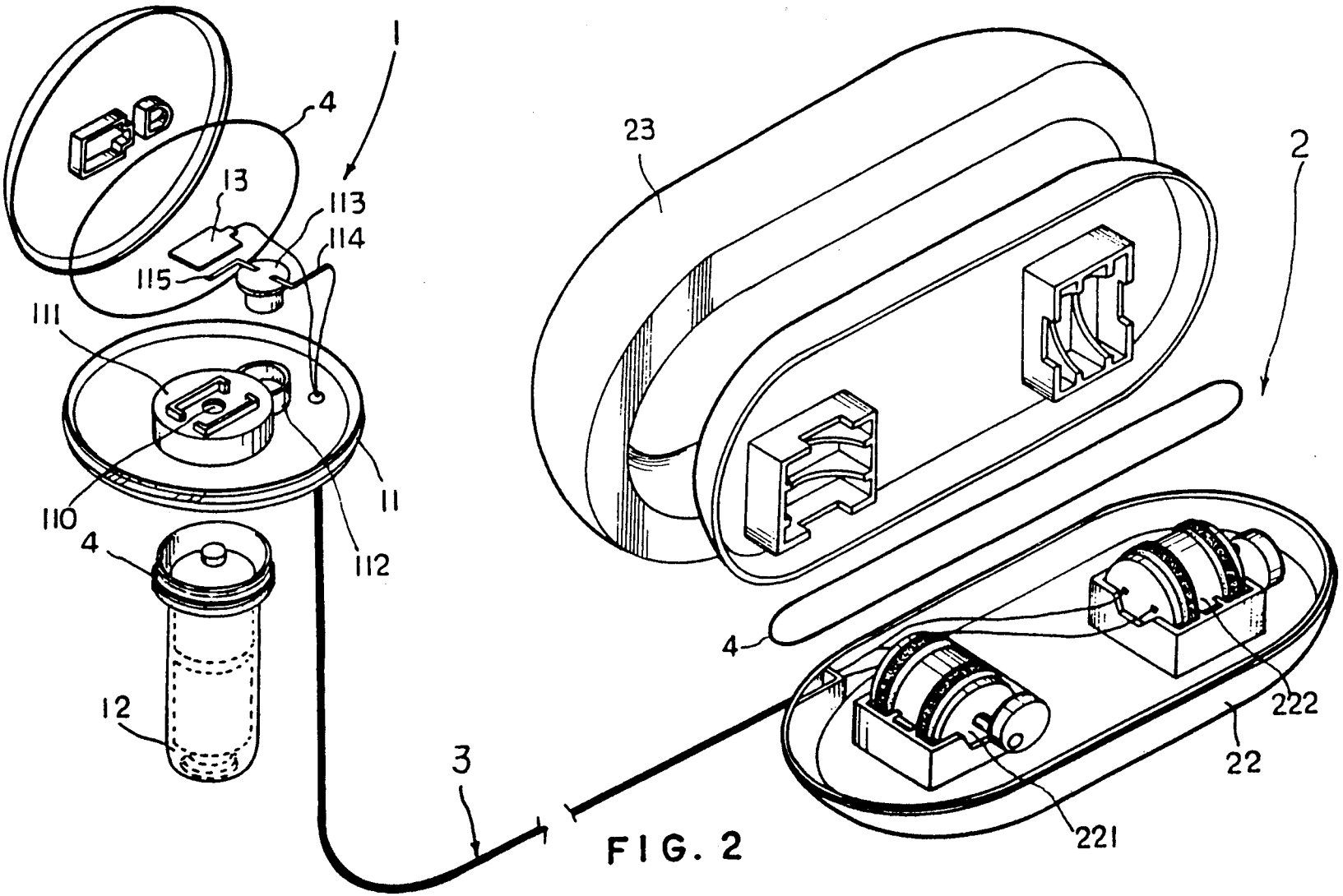
FIG. 2 is a dismantled perspective view thereof.
Figure 3B:
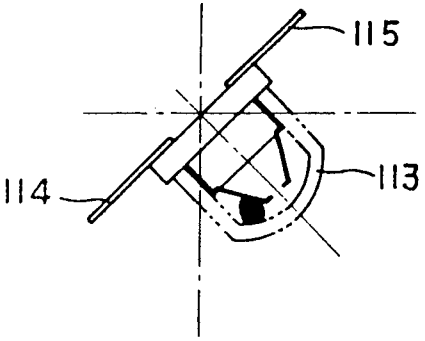
FIG. 3-A illustrates that the mercury switch of the power supply thereof has been electrically connected.
Figure 3A:
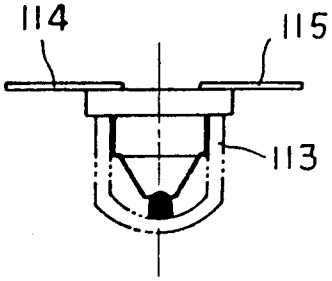

Referring to FIG. 2, the broad-brimmed housing or casing 11 of the power supply unit 1 comprises a seat 111 for fastening the battery box 12 through screw joint, a chamber 112 for holding a mercury switch 113 which is electrically connected when the broad-brimmed casing 11 is maintained in a horizontal position (i.e., when the battery box 12 is disposed in a vertical position as shown in FIG. 3-A) or electrically cut off when the broad-brimmed casing 11 (or the battery box 12) is tilted (as shown in FIG. 3-B).

The vibrator assembly 22 of the vibrator unit 2 comprises at least two vibrators 221, 222 disposed at right angle against each other (each vibrator 221 or 222 is comprised of a DC motor and a cam) and electrically connected to the power supply unit 1 by the electric wire 3. Before attaching to the mattress 21, the vibrator assembly 22 is covered with a layer of sponge 23. The electric wire 3 has one end connected to the vibrators 221, 222 and an opposite end respectively connected to a contact 114 at the mercury switch 113 and a conductive strip 13 which is fastened in the seat 111 at the top and electrically connected to the positive terminal of the battery set in the battery box 12. The positive terminal of the battery set in the battery box 12 is inserted through a hole 110 on the seat 111 to electrically contact the conductive strip 13. The opposite contact 115 of the mercury switch 113 is connected to the negative terminal of the battery set in the battery box 12. Therefore, once the mercury switch 113 is electrically connected, the vibrators 221, 222 are simultaneously turned on, causing the vibrator unit 2 to shake steadily.

Figure 4:
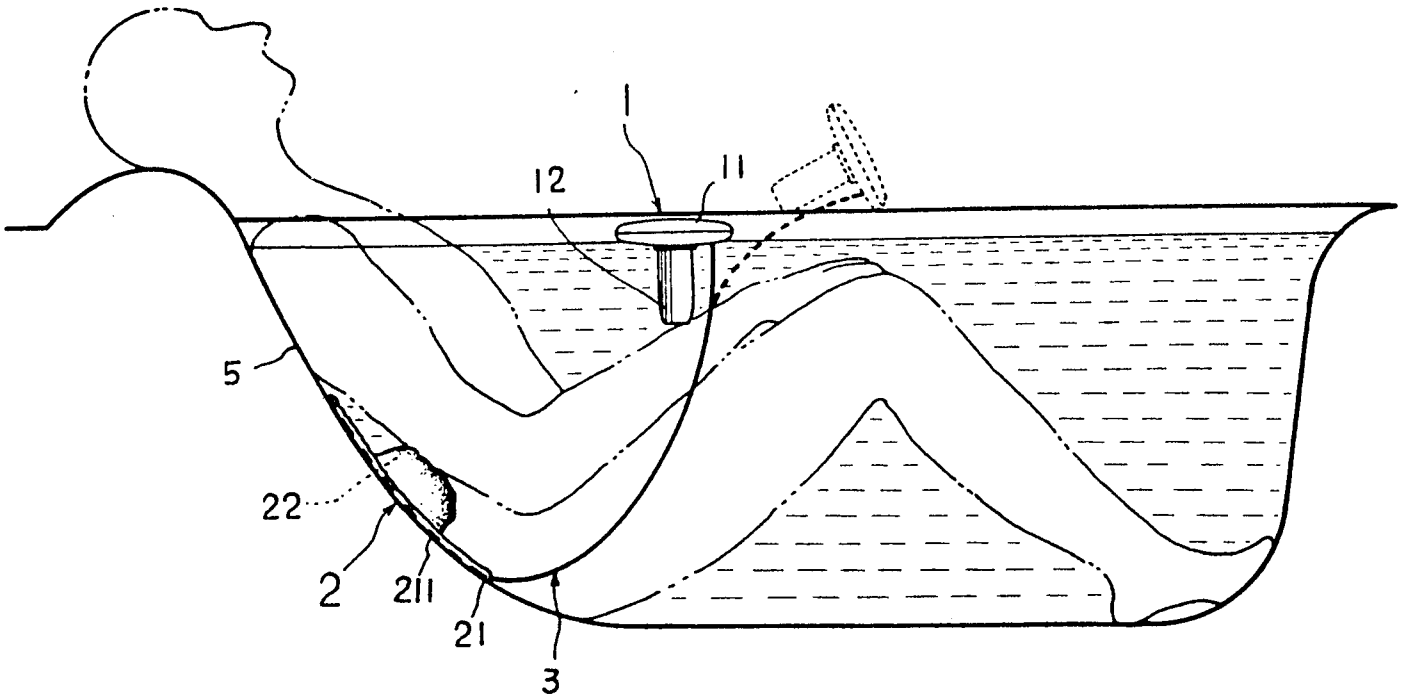
FIG. 4 illustrates the use of the present invention under the water in a bathtub.
Figure 5:
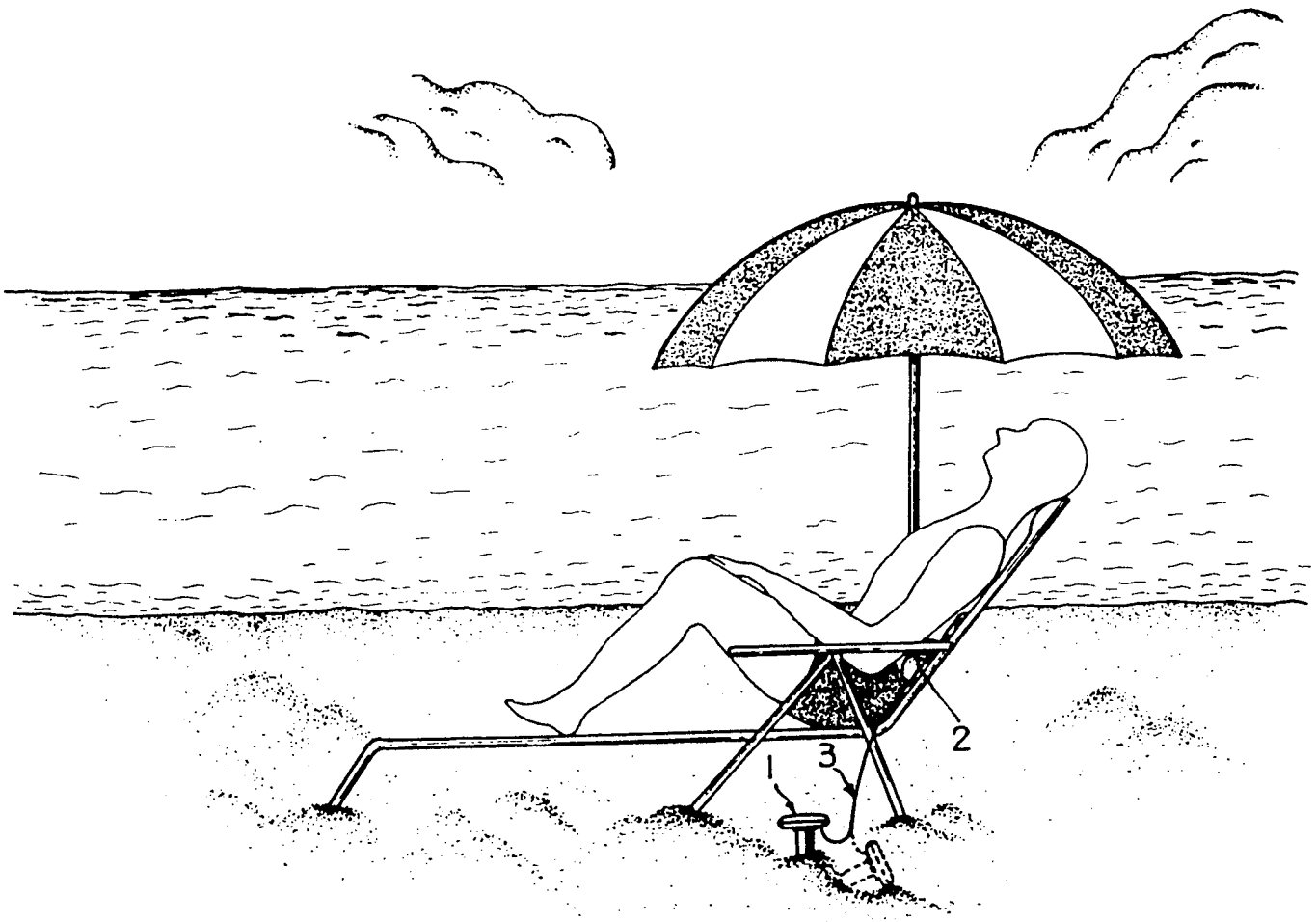
FIG. 5 illustrates the use of the present invention in a beach chair to massage the body of the person who lies thereon.

Further, the connection between the broad-brimmed casing 11 and the battery box 12 as well as the mattress 21 and the vibrator assembly 22 of the vibrator unit 2 are respectively sealed with a water seal ring 4. The power supply unit as shown in FIGS. 1 and 2 comprises a generally mushroom-shaped buoyant housing or casing 11 having a broad brimmed upper portion and a relatively narrow downwardly-extending lower portion. A battery box is disposed in the lower portion so that when placed in water the casing will float in an upright position with the relatively narrow downwardly-extending lower portion below the surface of the water. The connection between the electric wire 3 and the power supply unit 1 has been properly sealed and, the connection between the electric wire 3 and the vibrator unit 2 has also been well sealed. Therefore, as shown in FIG. 4, the present invention can be fastened in a bathtub 5 by attaching the suction discs 211 to the surface of said bathtub 5 and dipped under the water therein for massaging operation. Because the power supply unit 1 comprises a broad-brimmed casing 11, it will float in the water when it is placed in the bathtub 5. When the broad-brimmed casing 11 of the power supply unit 1 is floating in the water in the bathtub 5, the mercury switch 113 is electrically connected and, the vibrator unit 2 is triggered to vibrate. When the power supply unit 1 is tilted or placed in a sloping position (as shown in the dotted line in FIG. 4), the mercury switch 113 is cut off and the vibrator unit 2 stops its operation immediately. Referring to FIG. 5, when the massager is placed in a chair for massaging the person who lies thereon, the power supply unit 1 shall be fastened in a vertical position so that the mercury switch 113 is disposed in a vertical position, i.e. the mercury switch 113 is electrically connected to trigger the vibrator unit 2 to operate. Once the power supply unit 1 falls or is caused to fall on the ground (as shown in the dotted line), electric power supply is immediately cut off from the vibrator unit 2 and the vibrator unit 2 immediately stops its operation.

As indicated, the present invention is to provide a massager which is convenient to carry, easy to operation and practical in use and, which can also be used under water.

What is claimed is:

1. A massager comprising:

a power supply unit comprising a generally mushroom-shaped buoyant housing having a broad-brimmed upper portion and a relatively narrow downwardly-extending lower portion, a battery box disposed in said relatively narrow downwardly-extending lower portion and a battery disposed in said battery box so that said unit when placed in water will float in an upright position with said relatively narrow downwardly-extending portion below the surface of the water, a mercury switch disposed in said upright position and means for positioning said mercury switch in a position so that the switch is in a closed position when said unit is upright;

a vibrator unit comprising a vibrator assembly including two vibrators disposed at right angles against one another and a layer of mattress covering said vibrator assembly, said mattress having a plurality of raised portions on the top for massaging and a plurality of suction discs and hanging means for securing said unit to an object are fixed to said unit;

an electric wire electrically connected to said power supply unit and said vibrator unit by said mercury switch, said electric wire connected to the positive pole of said battery unit and to a first contact of said mercury switch and said electric wire connecting the negative pole of said battery to said second contact of said mercury switch so that current will flow from said battery to said vibrator unit when said switch is closed by said unit being in an upright position and will not flow when said switch is open as a result of said unit being tilted, said power supply unit, said vibrator unit and said electric wire being respectively sealed against water so that the massager can be used under water.

* * * * *